United States Patent [19]

Phillips et al.

[11] Patent Number: 4,610,060

[45] Date of Patent: Sep. 9, 1986

[54] DRAFTING SYSTEM FOR YARNS

[75] Inventors: Bobby M. Phillips, Kingsport, Tenn.; Bobby D. Duncan, Abingdon, Va.

[73] Assignee: Eastman Kodak Company, Rochester, N.Y.

[21] Appl. No.: 800,255

[22] Filed: Nov. 21, 1985

Related U.S. Application Data

[63] Continuation-in-part of Ser. No. 644,299, Aug. 27, 1984, abandoned, which is a continuation-in-part of Ser. No. 533,040, Sep. 16, 1983, abandoned.

[51] Int. Cl.[4] ..... D02J 1/22

[52] U.S. Cl. ..... 28/246; 57/310; 264/290.7

[58] Field of Search ..... 28/245, 246; 57/310; 264/290.5, 290.7

[56] References Cited

U.S. PATENT DOCUMENTS

| | | | |
|---|---|---|---|
| 2,611,923 | 9/1952 | Hume | 28/246 X |
| 2,942,325 | 6/1960 | Spellman, Jr. | 28/246 X |
| 3,154,807 | 11/1964 | Muller et al. | 28/246 |
| 3,296,418 | 1/1967 | Johnson . | |
| 3,539,680 | 11/1970 | Fukushima et al. . | |
| 3,753,517 | 8/1973 | Takenaka et al. . | |
| 4,013,326 | 3/1977 | King . | |

FOREIGN PATENT DOCUMENTS

| | | | |
|---|---|---|---|
| 864530 | 4/1961 | United Kingdom | 28/246 |

*Primary Examiner*—Robert R. Mackey

*Attorney, Agent, or Firm*—Malcolm G. Dunn; William P. Heath, Jr.

[57] ABSTRACT

Drafting system for textile yarns and including a driven feed roll, a driven output roll, a low friction freely rotatable heated roll located between the driven feed roll and the driven output roll and operating at essentially the same surface speed as the driven feed roll, the freely rotatable heated roll being driven by engagement with the yarn and whereby sufficient yarn tension automatically is transferred upstream of the freely rotatable heated roll to pretension the yarn before it contacts the freely rotatable heated roll with drafting taking place near the location where the yarn leaves the freely rotatable heated roll to pass toward the driven output roll.

15 Claims, 5 Drawing Figures

DRAFTING SYSTEM FOR YARNS

This application is a continuation-in-part of U.S. application Ser. No. 644,299, filed Aug. 27, 1984 now abandoned, which was a continuation-in-part of application Ser. No. 533,040 filed Sept. 16, 1983, now abandoned.

TECHNICAL FIELD

The present invention is directed to a drafting system for yarns generally used for textile yarns and particularly is directed to a system for drafting yarns, such as polyester yarns, at speeds greater than 300 meters per minute up to 1500 meters per minute and greater.

BACKGROUND

There is considerable prior art in the drafting of yarns, and particularly for polyester yarns. U.S. Pat. No. 3,539,680 discloses one system where speeds disclosed are around 600 meters per minute to 1500 meters per minute; however, relatively speaking, this is a very expensive system requiring equipment and maintenance that we think can be omitted with the system that we propose herein.

Pretensioning yarn in a drafting system before the yarn contacts any heated device, whether such device be a fixed pin, a rotating roll, a stationary contact heater or other type of device, is an important contribution toward obtaining a uniformly dyeable and defect-free yarn. U.S. Pat. No. 3,539,680 mentioned above recognizes the importance of such pretensioning so as to minimize occurrence of "fluffs" and dyeing unevenness (Col. 4, lines 43–47). The patent discusses an arrangement for obtaining such pretension by providing the combination of a nip roller and a delivery roller, and employing a ratio of peripheral speeds of the delivery roller to the heated feed roller within the range of 1:1.001–1:1.030. Thus the patent discloses establishing a pretension zone which is designed to draw the yarn slightly, as indicated by the given ratio range, in order to achieve the required pretensioning. The patent indicates alternatively that a thread brake or guide may be used if it can impart uniform and predetermined tension.

Other types of drafting systems employ heated pins, heated plates, and heated plates with separator rolls, all of which are well known. The quality of the yarn produced on these systems, however, has been found to be generally poor due to the high level of broken filaments and poor dye uniformity than that produced on a system such as represented by the above-mentioned U.S. Pat. No. 3,539,680, and the problems of broken filaments and poor dye uniformity have been found to increase as the speed is increased. Broken filaments tend to cause defects, which cause waste and loss of time.

An object of our invention is to provide a low friction drafting system which provides automatic pretensioning of the yarn before the yarn contacts any heated device and without employing the usual structures upstream from such heated device to provide such pretensioning.

U.S. Pat. No. 3,919,748 discloses an apparatus for altering the length of a synthetic continuous filament or yarn strand. The apparatus comprises a first strand feeding means involving a driven feed roll and a separator idler roll; a first heating means in the form of a heated roll connected to and coaxial with the driven feed roll and having a separator idler roll; a second heating means in the form of a heated plate over which the yarn strand slides; a second feeding means in the form of a driven roller and a separator idler roller; and a driven take-up spool. All of the embodiments in the patent, except one, show the "first heating means", which is the heated roll, as being rigidly connected to the first driven feed roll. The exception is the embodiment shown in FIG. 4 where the "heated roller 20'''" turns freely on stud 23 of the swinging arm 26 and thus is turned only by the yarn strand as the yarn strand loops around the heated roller. The patentee does not give any reason for the purpose of this exception nor does he offer any advantages. There is no recognition by the patentee, therefore, that pretensioning of the yarn would automatically occur upstream of the heated roller 20' in the area between the exit of the yarn strand from the driven feed roll 17 (FIG. 4) and the initial contact of the yarn strand with the heated roller 20'. Although FIG. 4 does not illustrate a separator idler roller, it is assumed that it would be positioned as illustrated in FIG. 6. Also, although the patentee does not indicate in his discussion of the embodiment of FIG. 4 that the separator idler roller for heated roller 20' would need to be independently rotatable from the separator idler roller for the driven feed roll 17, it is assumed that this would be desirable. In reference to FIG. 6, therefore, a "thread guide" 37 is provided between the coaxially aligned driven feed roll and heated roller on one side and the separator idler rollers on the other side which serves to displace the yarn strand from the driven feed roll to the heated roller. Since this is probably a high tension zone, this thread guide in the embodiment of FIG. 4 will tend to damage the yarn strand which will lead to the generation of an excessive number of broken filaments in the yarn. The yarn strand filaments which are directly in contact with the surface of the thread guide 37 will be damaged to the extent that they will break in the subsequent drafting of the yarn strand.

Another object of the invention, therefore, is to insure that there is no frictional contact made with the yarn in the area between the exit of the yarn from the input feed roll and the initial contact of the yarn with the freely rotatable heated roll.

Still another object of our invention is to provide a low maintenance drafting system.

A further object of our invention is to provide a drafting system which will operate satisfactorily from a mechanical quality and dye uniformity standpoint, at speeds up to 1500 meters per minute and greater.

A still further object is to provide a less expensive drafting system for providing textile yarns of equivalent quality to those made by the process disclosed in U.S. Pat. No. 3,539,680.

DISCLOSURE OF INVENTION

In accordance with the present invention, we provide a drafting system for yarn which has a driven feed roll for feeding the yarn at a predetermined speed; a driven output roll for forwarding the yarn at a second predetermined speed greater than the first-mentioned speed; a low friction freely rotatable heated roll, the surface of which is heated to a predetermined temperature, the freely rotatable heated roll being located between the driven feed roll and the driven output roll; and a separator roll spaced adjacent to the freely rotatable heated roll and wherein the yarn is wrapped a plurality of times around the freely rotatable heated roll and the separator roll. The surface speed of the freely rotatable heated roll is operating slightly faster than the surface speed of the driven input roll with the freely rotatable heated roll being driven by engagement with the yarn. As a result, sufficient yarn tension automatically is transferred upstream of the freely rotatable heated roll to pretension the yarn before it contacts the freely rotatable heated roll. Drafting takes place near the location where the yarn leaves the freely rotatable heated roll to pass toward the driven output roll.

The essential features of the above described drafting system are:

(a) the steady state resistance to turning of the freely rotatable heated roll plus the separator roll, as measured by stress on the yarn being drafted, is no more than 0.25 grams/denier(drafted yarn) and is preferably <0.15 grams/denier(drafted yarn);

(b) the start-up resistance, which is primarily the inertia of the freely rotatable heated roll, is $$\text{no more than } \frac{0.000113 \text{ pounds} \times \text{square foot}}{\text{denier(drafted yarn)}} \text{ or}$$

$$\frac{4.86 \times 10^{-5}\text{newtons} \times \text{metres squared}}{\text{denier(drafted yarn)}} \text{ and is preferably}$$

$$\text{no more than } \frac{0.000075 \text{ pounds} \times \text{square foot}}{\text{denier(drafted yarn)}} \text{ or}$$

$$\frac{3.10 \times 10^{-5}\text{newtons} \times \text{metres squared}}{\text{denier(drafted yarn)}}, \text{ still more preferably}$$

$$\text{is no more than } \frac{0.000045 \text{ pounds} \times \text{square foot}}{\text{denier(drafted yarn)}} \text{ or}$$

$$\frac{1.86 \times 10^{-5}\text{newtons} \times \text{metres squared}}{\text{denier(drafted yarn)}} \text{ and most preferably is}$$

$$\text{no more than } \frac{0.000030 \text{ pounds} \times \text{square foot}}{\text{denier yarn)}} \text{ or}$$

$$\frac{1.24 \times 10^{-5}\text{newtons} \times \text{metres squared}}{\text{denier(drafted yarn)}} \text{ as obtained from}$$

$$\text{the equation } T = \frac{CWk^2\alpha}{\text{denier(drafted yarn)}}$$

wherein

T=torque (length×force)/per unit denier

C=constant depending on units selected k=radius of gyration (units of length)

$\alpha$=angular acceleration (radians per second squared)

W=weight (units of mass);

(c) the coefficient of friction between the yarn and the surface of the freely rotatable heated roll, as measured on a Rothschild Friction Tester (based on capstan equation) using 180° contact at a yarn speed of 10 meters/minute, is greater than 0.57;

(d) the separator roll being located at a position relative to the freely rotatable heated roll and relative to the direction of the path of yarn movement such that the angle of contact of the yarn with the surface of the freely rotatable heated roll is ≧30° on the first wrap and is ≧30° on the last wrap before the yarn leaves the freely rotatable heated roll; and (e) there is no frictional contact made with the yarn in the area where pretension occurs between the location where the yarn exits from the driven feed roll and the location where the yarn makes initial contact with the freely rotatable heated roll.

More specifically, the separator roll is located at a position relative to the freely rotatable heated roll and relative to the direction of the path of yarn movement so as to be either within the angular specification designated $$\frac{\alpha}{2} \pm \frac{\alpha}{6},$$

as shown in FIG. 4*a* of the drawings, or so as to be within quadrant "a", as shown in FIG. 4*b* of the drawings.

A device for thermally stabilizing the yarn may be located between the freely rotatable heated roll and the driven output roll, or the driven output roll may be heated so as to thermally stabilize the yarn, or the yarn may be thermally stabilized after the yarn leaves the driven output roll.

In the drafting system disclosed herein, greater than 60 percent and preferably 80 to 95 percent of the yarn draw tension is transferred upstream of the freely rotatable heated roll to pretension the yarn before the yarn touches the heated roll. It is important to realize that in the proposed drafting system of this invention it is the low friction character of the freely rotatable heated roll that enables the transmission of a significant portion of the draw tension upstream of the freely rotatable heated roll, thereby providing automatic or inherent pretensioning of the yarn.

The drafting system may include a low friction freely rotatable heated roll that is an air bearing, or it may be a ball bearing or any other low friction bearing arrangement. "Air bearing" and "ball bearing" are expressions used herein to describe a heated roll that may be supported for rotation either by an air bearing arrangement or a ball bearing arrangement.

Where the yarn being processed is polyester yarn, the predetermined temperature for the surface of the freely rotatable heated roll will be about 80° C. to about 120° C., and the temperature for the device for thermally stabilizing the yarn is such that the yarn temperature is about 120° C. to about 220° C. as it leaves the thermally stabilizing device.

BRIEF DESCRIPTION OF THE DRAWINGS

The details of our invention will be described in connection with the accompanying drawings, in which.

BEST MODE FOR CARRYING OUT THE INVENTION

Figure 1:
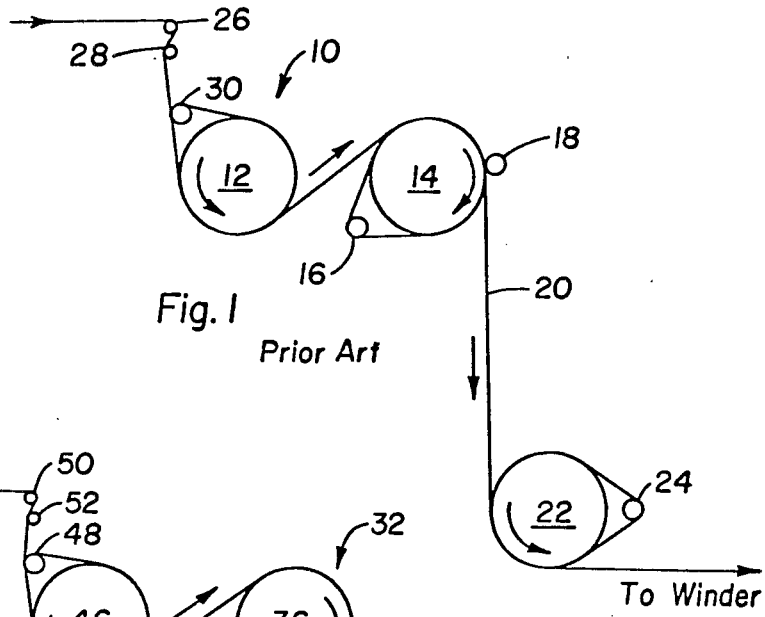
Fig. 1 Prior Art
FIG. 1 is a schematic elevational view of a prior art drafting system employing a pinch roll such as that disclosed in the above-mentioned U.S. Pat. No. 3,539,680.

FIG. 1 represents a prior art drafting system 10 such as disclosed in U.S. Pat. No. 3,539,680 in which a pretension zone for the yarn being processed is established between a nonheated godet roll 12 and a heated godet roll 14 and its separator roll 16, and a pinch roll 18 bearing against the heated godet roll 14 serves to minimize variability of the yarn drafting by preventing the drafting of the yarn 20 from extending upstream of the location of the pinch roll 18. The godet roll 22 and its separator roll 24 serve as an output roll arrangement for forwarding the yarn to a winder (not shown). Guides for the yarn are shown at 26 and 28, and 30 designates the separator roll for the nonheated godet roll 12.

Figure 2:
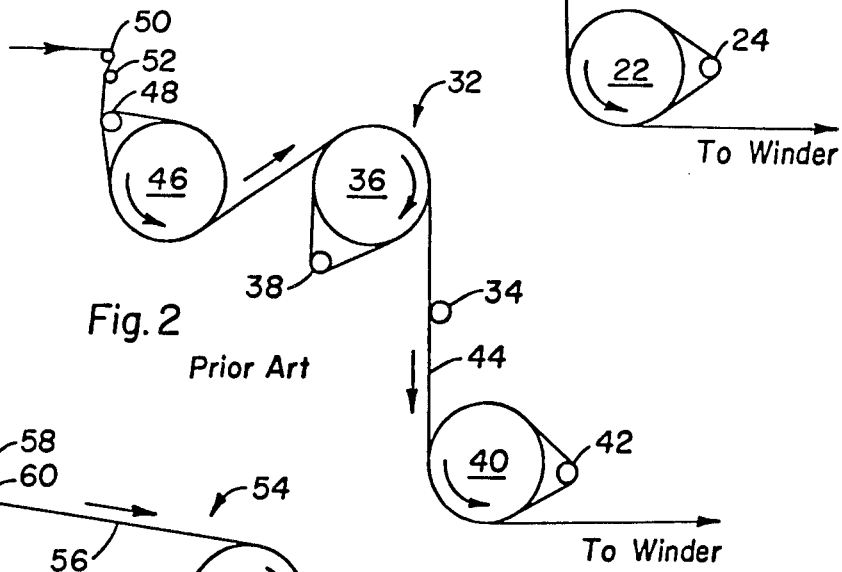
Fig. 2 Prior Art
FIG. 2 is a schematic elevational view of a prior art drafting system employing a heated pin.

FIG. 2 represents a prior art drafting system 32 which employs a heated stationary pin 34 between a nonheated godet roll 36 and its separator roll 38 and a nonheated godet roll 40 and its separator roll 42, the latter two serving as an output roll arrangement for forwarding the yarn 44 to a winder (not shown). Another nonheated godet roll 46 and its separator roll 48, as well as yarn guides 50 and 52 are shown located upstream of the first-mentioned nonheated godet roll 36.

The drafting systems of FIGS. 1 and 2 will be discussed later in relation to the drafting system of the present invention following a discussion of the essential features of the invention.

Figure 3:
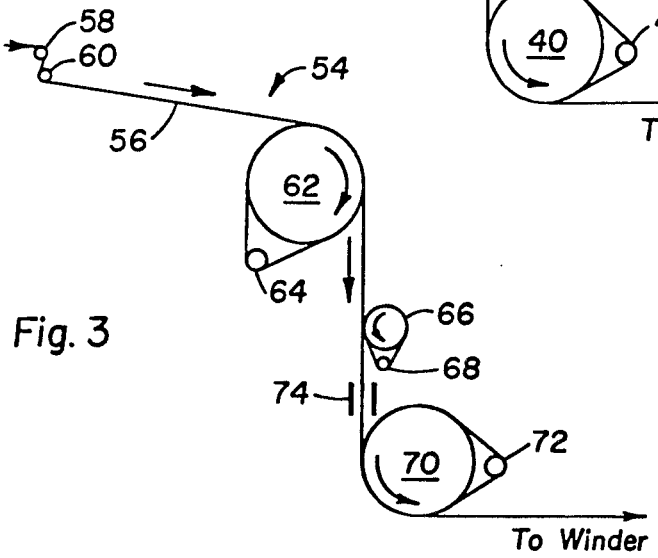
FIG. 3 is a schematic elevational view of the drafting system of the present invention employing a low friction freely rotatable heated roll and a post stabilizing device.

In FIG. 3, which represents the proposed drafting system 54 of the present invention, the yarn 56 is shown being guided over yarn guides 58 and 60 to a nonheated godet roll 62 and its adjacent separator roll 64. The yarn then passes to a low friction freely rotatable heated roll 66 and its adjacent separator roll 68 to be wrapped a plurality of times therearound before passing to the nonheated godet roll or output roll 70 and its adjacent separator roll 72 to be forwarded to a winder (not shown).

The yarn may be thermally stabilized by a device such as that represented at 74, which may be a slit or plate heater having either contact or noncontact with the yarn. Typical temperatures to be employed with a contact heater, when the yarn being processed is polyester, are such that the yarn temperature will be about 120° C. to about 220° C., and the freely rotatable heated roll surface temperature will be about 80° C. to about 120° C. as the yarn leaves the stabilizing device.

Alternatively the device for thermally stabilizing the yarn may be a device for heating the driven output roll; thus the driven output roll may be a heated godet roll. It is also within the scope of the invention that such heated godet roll may be a stepped godet roll such that controlled shrinkage may take place during thermal stabilization, or the yarn may be thermally stabilized after it leaves the output roll 70 and its separator roll 72.

As heretofore pointed out, we have discovered some essential features that must be present in our drafting system in order for our system to be effective. We have not found these features present in the prior art or recognized by the prior art.

First, the steady state resistance to turning of the freely rotatable heated roll plus the separator roll, as measured by stress on the yarn being drafted, must be no more than 0.25 grams/denier(drafted yarn) and preferably is <0.15 grams/denier(drafted yarn). Obviously, the steady state resistance to turning has two components: (1) bearing resistance and (2) air drag, with air drag being more sensitive to operating speed.

Second, the start-up resistance, which is primarily the inertia of the freely rotatable heated roll is $$\text{no more than } \frac{0.000113 \text{ pounds} \times \text{square foot}}{\text{denier(drafted yarn)}} \text{ or}$$

$$\frac{4.86 \times 10^{-5}\text{newtons} \times \text{metres squared}}{\text{denier(drafted yarn)}} \text{ and is preferably}$$

-continued $$\text{no more than } \frac{0.000075 \text{ pounds} \times \text{square foot}}{\text{denier(drafted yarn)}} \text{ or}$$

$$\frac{3.10 \times 10^{-5}\text{newtons} \times \text{metres squared}}{\text{denier(drafted yarn)}} \text{, still more preferably}$$

$$\text{is no more than } \frac{0.000045 \text{ pounds} \times \text{square foot}}{\text{denier(drafted yarn)}} \text{ or}$$

$$\frac{1.86 \times 10^{-5}\text{newtons} \times \text{metres squared}}{\text{denier(drafted yarn)}} \text{ and most preferably is}$$

$$\text{no more than } \frac{0.000030 \text{ pounds} \times \text{square foot}}{\text{denier yarn)}} \text{ or}$$

$$\frac{1.24 \times 10^{-5}\text{newtons} \times \text{metres squared}}{\text{denier(drafted yarn)}} \text{ as obtained from}$$

$$\text{the equation } T = \frac{CWk^2\alpha}{\text{denier(drafted yarn)}}$$

wherein

T=torque (length×force)/per unit denier

C=constant depending upon the units selected k=radius of gyration (units of length)

$\alpha$=angular acceleration (radians per second squared)

W=weight (units of mass)

For a given yarn at start-up, the torque is approximately constant and is generated by sliding frictional contact with the freely rotatable heated roll. Thus the resistance to turning is directly proportional to $Wk^2$. The torque generated to accelerate the freely rotatable heated roll is also proportional to denier because the area in contact with the heated roll increases as the denier increases. Thus, specifying that the pounds×square foot/denier(drafted yarn) [newtons×meters squared/denier(drafted yarn)] should not exceed a given number, is equivalent to saying that the angular acceleration will equal or exceed a minimum value and thereby minimize start-up time for the freely rotatable heated roll.

Obviously, startup performance, as the denier of the feed yarn is decreased, becomes poorer unless the $Wk^2$ of the freely rotatable heated roll is reduced correspondingly.

Third, the coefficient of friction between the yarn and the surface of the freely rotatable heated roll, as measured on a Rothschild Friction Tester (based on capstan equation) using 180° contact at a yarn speed of 10 meters/minute, is greater than 0.57, and is preferably in the range of 0.75 to 0.95. The capstan equation is well-known, but will be mentioned here as being $$\frac{T_2}{T_1} = e^{\mu\theta}$$

wherein $T_2$=tension of the yarn on the side of the capstan where yarn is being pulled $T_1$=tension of the yarn on the other side of the capstan e=base of natural logarithm $\mu$=coefficient of friction $\theta$=angle of wrap in radians The high coefficient of friction insures that the yarn will not slide on the freely rotatable heated roll during the first wrap and thereby undesirably initiate a kind of two-stage drafting. This also helps increase the torque at start-up which minimizes the time for the freely rotatable heated roll to accelerate to steady state.

Fourth, the separator roll should be located at a position relative to the freely rotatable heated roll and relative to the direction of the path of the yarn movement such that the angle of contact with the surface of the freely rotatable roll is $\geqq 30°$ on the first wrap and is $\geqq 30°$ on the last wrap before the yarn leaves the freely rotatable heated roll. Note, for example, the angle of wrap "x", which would be on the first wrap in FIGS. 4*a* and 4*b*, and the angle of wrap "y", which would be on the last wrap in FIGS. 4*a* and 4*b*.

Figure 4A:
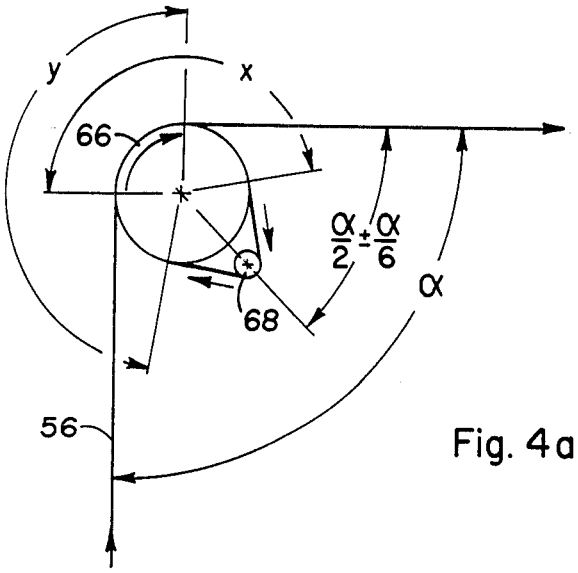
FIGS. 4*a* and 4*b* are schematic diagrams illustrating preferred locations for the separator roll relative to the freely rotatable heated roll and relative to the direction of the path of yarn movement.
Figure 4B:
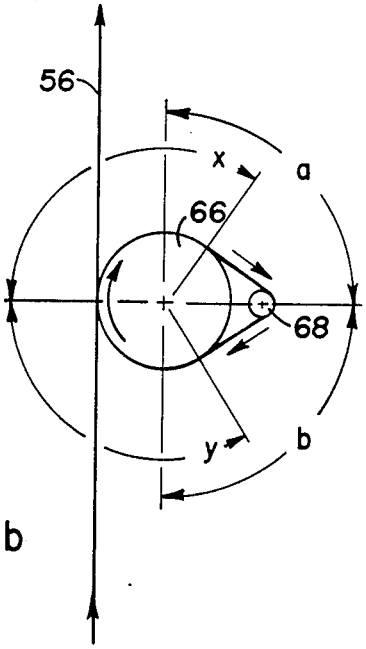

As also heretofore pointed out, the separator roll is located at a position relative to the freely rotatable heated roll and relative to the direction of the path of yarn movement so as to be either within the angular specification designated $$\frac{\alpha}{2} \pm \frac{\alpha}{6},$$

as shown in FIG. 4*a* of the drawings (not path of yarn 56 in FIG. 4*a*), or so as to be within quadrant "a", as shown in FIG. 4*b* of the drawings (note path of yarn 56 in FIG. 4*b*). The reason for the yarn being a quadrant "a" in FIG. 4*b*, for example, is that the yarn has a longer contact with the heated roll on the last wrap and thereby helps insure that no drafting will take place before the yarn leaves the freely rotatable heated roll. The distance between the separator roll and the freely rotatable heated roll should be minimized with about one (1) to two (2) inches (2.54 centimeters to 5 centimeters) being reasonable.

Fifth, there is no frictional contact made with the yarn in the area where pretension occurs between the location where the yarn exits from the driven feed roll and the location where the yarn makes initial contact with the freely rotatable roll. This feature is quite essential because any interference in this critical area, such as shown by the thread guide 37 in FIG. 6 of U.S. Pat. No. 3,919,748, as heretofore discussed, will cause damage to the yarn resulting in filament breakage in the subsequent drafting of the yarn.

The drafting systems of the prior art will now be discussed and compared with the drafting system of the present invention. Before doing so, however, we want to point out that the feed system for our invention does not have to be powered godets, as is often true in the prior art, but can be of any of the lesser-costing devices used on false twist texturing machines (i.e. rubber cots on shaft, casablancas).

U.S. Pat. No. 4,053,277 discloses a heated air bearing that in principle would be suitable for practice of the present invention. Although there is no disclosure in the patent where the thermocouple would be positioned to assure predetermined surface temperatures, we would suggest employing a thermocouple internally of the roll with its probe being positioned just beneath the surface of the roll such as disclosed in U.S. Pat. No. 3,879,594 or U.S. Pat. No. 3,296,418, for example. Air bearings or rolls are also shown in U.S. Pat. No. 4,013,326, U.S. Pat. No. 3,753,517, and U.S. Pat. No. 3,560,066. Ball bearing rolls may also be used and are conventional in the art, such as shown in U.S. Pat. No. 3,296,418. The design of such roll, however, must be of very low friction.

The freely rotatable heated roll 66 (FIG. 3) in our invention is wrapped with sufficient wraps to ensure heating of the yarn to approximately the surface temperature of the heated roll. Drafting of the yarn 56 takes place near the point where the yarn leaves the heated roll 66 for the last time on its way toward the output roll 70.

The output roll may be constructed in the same manner as the input roll, thus costs will be minimized and such construction will be simplified because the godet rolls shown do not require heating; thus maintenance will be reduced as compared to maintenance required for heated godet rolls. Obviously, the latter statement will only be partially true if the thermally stabilizing device should be incorporated in the output roll to make it in effect a heated godet roll.

The following drafting systems were evaluated. (1) A drafting system including a heated godet roll having a 0.5 meter circumference and a pinch roll such as disclosed in U.S. Pat. No. 3,539,680 and illustrated in FIG. 1; (2) the same drafting system as in (1) except the pinch roll was removed (not shown in the drawings); (3) a drafting system including a stationary 40 millimeter diameter heated stationary pin having a flame-coated ceramic surface, such as disclosed in FIG. 2; (4) the same drafting system as in (3) except that a stationary 80 millimeter diameter heated stationary pin was used; (5) a drafting system including a 70 millimeter diameter freely rotatable heated roll was used, such as is illustrated in FIG. 3.

A polyester (from polyethylene terephthalate polymer) POY (partially oriented yarn) was used to evaluate the drafting systems. See U.S. Pat. No. 4,245,001 for a description of the polymer and spinning conditions for making the POY. The numbers shown in the tables below are highly dependent upon the quality of the polymer from which the yarns were spun and the spinning process from which they were made. Thus the true significance of these numbers is determined only by looking at the relative values among the systems as opposed to the absolute numbers. As noted in the tables, no post stabilization device was used in obtaining the results shown in the tables.

The drafting systems were evaluated with the above-described yarn to determine optimum drafting conditions for each system at 400 meters per minute and at 1000 meters per minute drafting speeds. The drafting system of our invention ran so smoothly at 1000 meters per minute that we see no problems in running it up to 1500 meters and greater. After optimum drafting conditions were determined for each system, the systems were then compared to each other, as shown by the tables below.

Drafting Conditions for Polyester POY 270 denier/30 filaments[1]

| | Preheating Temperature Set Pt., °C. | Broken Filaments (ct./1000 m) X** | Broken Filaments (ct./1000 m) S*** | % Uster |
|---|---|---|---|---|
| Heated Air Bearing | 100 | 2.33 | 1.66 | 3.12 |
| 8 wraps | 120 | 1.89 | 1.17 | 1.95 |
| 645/1000 m/m | 140 | 0.33 | 0.50 | 0.66 |
| | 150* | 0.11 | 0.33 | 0.67 |
| | 160 | 0.11 | 0.33 | 0.70 |
| Heated Air Bearing | 120 | 0.67 | 1.32 | 0.62 |
| 8 wraps | 140* | 0.00 | 0.00 | 0.78 |
| 258/400 m/m | 150 | 2.78 | 1.56 | 0.77 |
| | 160 | 11.00 | 4.73 | 0.79 |
| 80 mm Hot Pin | 70 | 9.67 | 3.00 | 6.92 |
| 1-360° wrap | 80 | 14.11 | 3.98 | 7.23 |
| 645/1000 m/m | 90 | 19.67 | 3.90 | 7.18 |
| 80 mm Hot Pin | 70 | 4.89 | 2.09 | 5.60 |

-continued

| Drafting Conditions for Polyester POY 270 denier/30 filaments[1] | | | | |
|---|---|---|---|---|
| | Preheating Temperature Set Pt., °C. | Broken Filaments (ct./1000 m) X** | S*** | % Uster |
| 1-360° wrap | 80 | 2.67 | 2.34 | 5.20 |
| 258/400 m/m | 100* | 4.00 | 2.34 | 2.24 |
| | 120 | 14.22 | 4.27 | 1.00 |
| 40 mm Hot Pin | 80 | 12.87 | 3.94 | 6.97 |
| 1-360° wrap | 90 | 28.33 | 6.40 | 7.25 |
| 645/1000 m/m | 100 | 45.44 | 8.68 | 7.20 |
| | 120 | 100.33 | 10.69 | 6.62 |
| | 140 | 127.67 | 14.57 | 5.40 |
| 40 mm Hot Pin | 70 | 3.44 | 1.81 | 6.78 |
| 1-360° wrap | 80 | 6.44 | 3.50 | 6.83 |
| 258/400 m/m | 90 | 5.44 | 2.40 | 6.20 |
| | 100 | 4.44 | 2.60 | 5.20 |
| Heated Godet (no pinch) | 80 | 1.33 | 1.41 | 3.33 |
| 8 wraps | 95 | 1.00 | 1.32 | 2.72 |
| 645/1000 m/m | 100 | 0.56 | 0.73 | 1.82 |
| | 100* | 1.56 | 0.88 | 0.73 |
| | 120 | 43.3 | 8.66 | 0.68 |
| Heated Godet (with pinch) | 105 | 0.00 | 0.00 | 0.93 |
| 8 wraps | 110* | 0.00 | 0.00 | 0.73 |
| 645/1000 m/m | 115 | 0.33 | 0.50 | 0.72 |
| Heated Godet (no pinch) | 60 | 17.77 | 7.97 | 2.65 |
| 8 wraps | 80 | 9.56 | 2.96 | 2.60 |
| 258/400 m/m | 90 | 0.11 | 0.33 | 1.31 |
| | 95* | 0.44 | 0.53 | 0.86 |
| | 100 | 4.33 | 2.45 | 0.95 |
| | 110 | 102.20 | 17.75 | 0.93 |
| | 120 | 393.10 | 63.07 | 1.45 |
| Heated Godet (with pinch) | 90 | 0.22 | 0.44 | 1.40 |
| 8 wraps | 95* | 0.11 | 0.33 | 0.88 |
| 258/400 m/m | 100 | 0.78 | 1.64 | 0.80 |

*optimum conditions
**mean of nine (9) separate measurements on 1000 meters of drawn yarn
***standard deviation
[1]no post stabilization was used in obtaining these results

TABLE 2

| Determination of Optimum Number of Wraps for Heated Air Bearing on Polyester POY 270 denier/30 filaments[3] | | | | | |
|---|---|---|---|---|---|
| Heated Air Bearing 645/1000 m/m 150° C. set point | No. of Wraps | Draw Tension (g) before**/ after*** | Broken Filaments X[1] BF/ 1000 m | S[2] BF/ 1000 m | % Uster |
| | 2 | 80-108 | 18.4 | 4.8 | 4.00 |
| | 4 | 50-92 | 3.1 | 2.4 | 1.48 |
| | 6 | 48-90 | 1.4 | 1.0 | 0.63 |
| | *8 | 42-100 | 0.2 | 0.4 | 0.68 |
| | 10 | 55-105 | 0.1 | 0.3 | 0.70 |
| | 12 | 52-115 | 0.1 | 0.3 | 0.67 |
| | 14 | 68-105 | 0.2 | 0.3 | 0.78 |

*optimum conditions
**pretension
***draw tension
[1]mean of nine (9) separate measurements on 1000 meters of drawn yarn
[2]standard deviation
[3]no post stabilization was used in obtaining these results

TABLE 3

| Best Operating Conditions for Drawing Polyester POY[3] | | | | | |
|---|---|---|---|---|---|
| POY | Speed, m/m | H.A.B.* Set Point, (°C.) | Uster % | X[1] BF/ 1000 m | S[2] BF/ 1000 M |
| 120/20 | 649/1000 | 130 (113 S.T.**) | 0.50 | 0.0 | 0.0 |
| 120/20 | 325/500 | 110 (96 S.T.**) | 0.70 | 0.0 | 0.0 |
| 125/20*** | 625/1000 | 130 (113 S.T.**) | 0.70 | 0.0 | 0.0 |
| 125/20 | 312/500 | 110 (96 S.T.**) | 0.71 | 0.0 | 0.0 |
| 270/30 | 645/1000 | 150 | 0.67 | 0.1 | 0.3 |

TABLE 3-continued

| Best Operating Conditions for Drawing Polyester POY[3] | | | | | |
|---|---|---|---|---|---|
| POY | Speed, m/m | H.A.B.* Set Point, (°C.) | Uster % | X[1] BF/ 1000 m | S[2] BF/ 1000 M |
| 270/30 | 258/400 | (130 S.T.**) 140 (122 S.T.**) | 0.78 | 0.0 | 0.0 |

*H.A.B.—heated air bearing
**S.T.—surface temperature
*** $\frac{\text{Pretension}}{\text{Draw Tension}} = \frac{38 \text{ gms}}{48 \text{ gms}} \times 100 = 79\%$
[1]mean of nine (9) separate measurements on 1000 meters of drawn yarn
[2]standard deviation
[3]no post stabilization was used in obtaining these results Table 1 shows the Uster uniformity and broken filament results from the different drafting systems and the conditions evaluated using a partially oriented yarn (POY) of polyester (270 denier/30 filaments from polyethylene terephthalate).

Table 2 shows the Uster uniformity and broken filament results at various numbers of wraps on the surface of the 70 millimeter diameter heated air bearing or heated roll. Optimum drafting conditions for various POY yarns using the 70 millimeter diameter heated air bearing are shown in FIG. 3.

In reference to Table 1 again, in general as the temperature of the drafting device increases the level of broken filaments for the yarn decreases, passes through a minimum and then increases. The Uster uniformity behaves similarly. The drafting conditions which gave the minimum Uster uniformity and broken filament level was chosen as the optimum drafting condition, and it is indicated with a single asterisk in Table 1. The 70 millimeter diameter heated air bearing was found to perform as well as the heated godet with the pinch roll and better than either of the two heated pins or the heated godet roll without a pinch roll.

The number of wraps on the heated air bearing was found to be an important variable as shown in Table 2. The optimum number of wraps was found to be eight for a drafting speed of 1000 meters per minute, draw ratio of 1.55× and a set point of the heated air bearing of 150° C. Increasing the number of wraps above eight did not appear to lower the Uster uniformity or the broken filament level. Also shown in Table 2 is the draw tension before and after the heated air bearing as a function of the number of wraps. For the above conditions and eight wraps, the tension before the heated air bearing or the pretension was found to be about 42 grams with the tension after the heated air bearing being about 100 grams. Obviously, this particular combination of yarn, number of wraps, speed, etc., causes an unusually large drag to exist on the heated roll. In this case a tension of 60 grams or higher would be preferred. It will be noted that as the wraps increased after eight, the pretension increased. A speed check with a Strobe light showed the heated air bearing or freely rotatable heated roll surface to be moving only slightly faster than the feed roll. This was very surprising to us. This feature occurs because the dynamic stress strain curve of the undrawn yarn was found to be Hookean over the tension ranges encountered before the yarn makes contact with the heated roll and under these conditions the yarn exhibits a very high dynamic modulus.

The best operating temperatures for the yarns when drafting on the 70 millimeter diameter heated air bearing using eight wraps are shown in Table 3. Higher speed or larger total deniers were found to require higher operating temperature of the heated air bearing or heated roll. Therefore, each yarn will have its own particular optimum temperature settings.

Actual surface temperature of the heated air bearing or heated roll, as measured with a contact thermocouple (not shown) immediately after stopping the rotating surface (see Table 3), was lower than the set point temperature. "Set point temperature" is the temperature established within the heated roll, and does not mean the surface temperature of the roll. This difference was caused by the location of the thermocouple which was in the unit core rather than in the rotating surface.

Dyed socks made from the yarns which were drawn on the heated air bearing or heated roll at 1000 meters per minute had excellent uniformity. They were found to be superior to the yarns produced on the fixed heat pins and equivalent to those produced on the heated godet system without a pinch roll.

The following is an example of an effective drafting system as disclosed herein.

EXAMPLE 1

One freely rotatable heated roll was constructed using ball bearings. The diameter of the roll was 70 mm and its $Wk^2$ was 0.0045 lbs×ft$^2$ or 0.00186 newtons×meters squared.

The roll had a polished chrome surface with a coefficient of friction of 0.85. This roll was used to draft polyester filament yarn under the conditions listed below:

Draw ratio—1.60×
Pin temperature (set point)—100° C.
Stabilization plate temperature—160° C.
Speed—300 m/min
The measured percent of draw tension transferred upstream into the pretension zone was about 92%.
The feed yarn was 225(140)/25 POY The yarns produced dyed uniformly and contained less than 0.3 broken filaments per pound of yarn. Start-up was also adequate.

The following example is used to determine and define important variables related to the successful operation of the drafting system disclosed herein.

EXAMPLE 2

Another freely rotatable heated roll was constructed using ball bearings. The diameter of the roll was 70 mm and its $Wk^2$ was also 0.0045 lbs.×ft$^2$. The surface, however, was plasma coated ceramic with a coefficient of friction of 0.29. When running a temperature series on the roll, an unusual phenomenon was observed. The feed yarn was 225(140)/25 polyester POY.

Draw ratio—1.60×
Stabilization plate temperature—140° C.
Speed—800 m/min
The measured percent of draw tension transferred upstream into the pretension zone was about 85%.
The separator roll was located as shown in FIG. 3 such that the wrap angle for the first wrap was approximately 30°.

| Set Point on Roll °C. | In Out Speed M/Min | Surface Speed of Roll M/Min |
|---|---|---|
| 60 | 500 | 510 |
| 80 | 500 | 510 |

-continued

| Set Point on Roll °C. | In Out Speed M/Min | Surface Speed of Roll M/Min |
|---|---|---|
| 100 | 500 | 510 |
| 110 | 500 | 548 |
| 120 | 500 | 607 |
| 128 | 500 | 658 |

Notice that at 100° C. and below the surface speed of the roll differs from the input speed by about 2%. This 2% represents the elastic extension of the POY under the pretension load. This elastic extension is the reason the roll operates slightly faster than the feed roll speed. However, at 110° C. and above, there is some obvious drafting of the yarn taking place before it establishes good frictional contact with the surface of the roll. This two-stage drafting behavior is undesirable.

Two ways were found to eliminate this undesirable behavior. The first was to increase the wrap angle on the first wrap to 270° or more. This is not a very practical method. The second approach was to use a roll surface with a higher coefficient of friction. A polished chrome surface roll was constructed with a coefficient of friction of 0.85. No two-stage drafting was observed with this surface. Thus combinations of increased wrap angle and/or increased coefficient of friction between the yarn and the roll surface can be used to eliminate the two-stage drafting.

EXAMPLE 3

One freely rotatable heated roll was constructed using ball bearings. The diameter of the roll was 70 mm and its $Wk^2$ was 0.0045 lbs×ft$^2$ or 0.00186 newtons×meters squared.

The roll had a polished chrome surface with a coefficient of friction of 0.85. This roll was used to draft polyester filament yarn under the conditions listed below:

Draw ratio—1.60×
Pin temperature (set point)—100° C.
Stabilization plate temperature—160° C.
Speed—300 m/min
The measured percent of draw tension transferred upstream into the pretension zone was about 92%.
The feed yarn was 96(60)/20 POY The yarns produced dyed uniformly and contained less than 0.3 broken filaments per pound of yarn. Start-up was marginal.

The invention has been described in detail with particular reference to preferred embodiments thereof, but it will be understood that variations and modifications can be effected within the spirit and scope of the invention.

We claim:

1. A drafting system for yarn comprising: driven feed means for feeding said yarn at a predetermined speed; driven output means for forwarding said yarn at a second predetermined speed greater than said first-mentioned predetermined speed; a low friction freely rotatable heated roll, the surface of which is heated to a predetermined temperature, said freely rotatable heated roll being located between said driven feed means and said driven output means; and a separator roll spaced adjacent to said freely rotatable heated roll and wherein said yarn is wrapped a plurality of times around said freely rotatable heated roll and said separator roll; and the surface speed of said freely rotatable heated roll is operating slightly faster than the surface speed of said driven input means, with said freely rotatable heated roll being driven by engagement with said yarn and whereby sufficient yarn tension automatically is transferred upstream of said freely rotatable heated roll to pretension said yarn before it contacts said freely rotatable heated roll with drafting taking place near the location where said yarn leaves said freely rotatable heated roll to pass toward said driven output means, and wherein:

(a) the steady state resistance to turning of the freely rotatable heated roll plus separator roll, as measured by stress on the yarn being drafted, is no more than 0.25 grams/denier (drafted yarn), (b) the start-up resistance, which is primarily the inertia of the freely rotatable roll, is $$\text{no more than } \frac{0.000113 \text{ pounds} \times \text{square foot}}{\text{denier(drafted yarn)}} \text{ or}$$

$$\frac{4.86 \times 10^{-5} \text{ newtons} \times \text{meters squared}}{\text{denier(drafted yarn)}} \text{ as obtained from}$$

$$\text{the equation } T = \frac{CWk^2\alpha}{\text{denier(drafted yarn)}}$$

wherein

T=torque (length×force)/per unit denier

C=constant depending on units selected k=radius of gyration (units of length)

$\alpha$=angular acceleration (radians per second squared)

W=weight (units of mass), (c) the coefficient of friction, between the yarn and the surface of the freely rotatable heated roll as measured on a Rothschild Friction Tester (based on capstan equation) using 180° contact at a yarn speed of 10 meters/minute, is greater than 0.57, (d) the separator roll being located at a position relative to the freely rotatable heated roll and relative to the direction of the path of yarn movement such that the angle of contact of the yarn with the surface of the freely rotatable heated roll is ≧30° on the first wrap and is ≧30° on the last wrap before the yarn leaves the freely rotatable heated roll, and (e) there is no frictional contact made with the yarn in the area where pretension occurs between the location where the yarn exits from the driven feed means and the location where the yarn makes initial contact with the freely rotatable heated roll.

2. A drafting system as defined in claim 1 wherein said steady state resistance to turning of the freely rotatable heated roll plus separator roll, as measured by stress on the yarn being drafted, is ≧0.15 grams/denier(drafted yarn), and said start-up resistance is $$\text{no more than } \frac{0.000045 \text{ pounds} \times \text{square foot}}{\text{denier(drafted yarn)}} \text{ or}$$

$$\frac{1.86 \times 10^{-5} \text{newtons} \times \text{metres squared}}{\text{denier(drafted yarn)}}.$$

3. A drafting system as defined in claim 1 wherein said coefficient of friction is in the range of 0.75 to 0.95.

4. A drafting system as defined in claim 1 wherein said separator roll is located at a position relative to the freely rotatable heated roll and relative to the direction of the path of yarn movement so as to be within the angular specification designated $$\frac{\alpha}{2} \pm \frac{\alpha}{6}$$

shown in FIG. 4*a* of the drawings.

5. A drafting system as defined in claim 1 wherein said separator roll is located at a position relative to the freely rotatable heated roll and relative to the direction of the path of yarn movement so as to be within quadrant "a" shown in FIG. 4*b* of the drawings.

6. A drafting system as defined in claim 1 and including means for thermally stabilizing the yarn.

7. A drafting system as defined in claim 6 wherein said means for thermally stabilizing the yarn is located between said freely rotatable heated roll and said driven output means.

8. A drafting system as defined in claim 6 wherein said means for thermally stabilizing the yarn is a means for heating said driven output means.

9. A drafting system as defined in claim 6 wherein said yarn is a polyester yarn and said predetermined temperature for said surface of said freely rotatable heated roll is about 80° C. to about 120° C. and the temperature for said means for thermally stabilizing said yarn is such that the yarn temperature is about 120° C. to about 220° C. as the yarn leaves said means for thermally stabilizing said yarn.

10. A drafting system as defined in claim 1 wherein greater than 60 percent of yarn draw tension is transferred upstream of said freely rotatable heated roll.

11. A drafting system as defined in claim 1 wherein 80 to 95 percent of yarn draw tension is transferred upstream of said freely rotatable heated roll.

12. A drafting system as defined in claim 1 wherein said low friction freely rotatable heated roll is supported for rotation on an air bearing.

13. A drafting system as defined in claim 1 wherein said low friction freely rotatable heated roll is supported for rotation on ball bearings.

14. A drafting system as defined in claim 1 wherein said steady state resistance to turning of the freely rotatable heated roll plus separator roll, as measured by stress on the yarn being drafted, is <0.15 grams/denier(drafted yarn), and said start-up resistance is $$\text{no more than } \frac{0.000075 \text{ pounds} \times \text{square foot}}{\text{denier(drafted yarn)}} \text{ or}$$

$$\frac{3.10 \times 10^{-5} \text{newtons} \times \text{metres squared}}{\text{denier(drafted yarn)}}.$$

15. A drafting system as derined in claim 1 wherein said steady state resistance to turning of the freely rotatable heated roll plus separator roll, as measured by stress on the yarn being drafted, is <0.15 grams/denier(drafted yarn), and said start-up resistance is $$\text{no more than } \frac{0.000030 \text{ pounds} \times \text{square foot}}{\text{denier(drafted yarn)}} \text{ or}$$

$$\frac{1.24 \times 10^{-5} \text{newtons} \times \text{metres squared}}{\text{denier(drafted yarn)}}.$$

* * * * *